United States Patent [19]

Ridgway et al.

[11] Patent Number: 4,658,624

[45] Date of Patent: Apr. 21, 1987

[54] BENDING MACHINES

[75] Inventors: Charles I. Ridgway; John R. Coultish, both of Wakefield, United Kingdom

[73] Assignee: Joseph Rhodes Limited, Wakefield, England

[21] Appl. No.: 719,279

[22] PCT Filed: Aug. 2, 1984

[86] PCT No.: PCT/GB84/00266

§ 371 Date: Apr. 1, 1985

§ 102(e) Date: Apr. 1, 1985

[87] PCT Pub. No.: WO85/00766

PCT Pub. Date: Feb. 28, 1985

[30] Foreign Application Priority Data

Aug. 2, 1983 [GB] United Kingdom ..... 8320764

[51] Int. Cl.[4] ..... B21D 5/04

[52] U.S. Cl. ..... 72/316; 72/323; 72/461

[58] Field of Search ..... 72/322, 323, 321, 319, 72/316, 447, 461, 384

[56] References Cited

U.S. PATENT DOCUMENTS

| | | | |
|---|---|---|---|
| 274,741 | 3/1883 | Dull | 72/322 |
| 1,349,219 | 8/1920 | Moore et al. . | |
| 1,815,102 | 7/1931 | Hinrich | 72/321 |
| 2,208,061 | 7/1940 | Warger | 72/321 |
| 2,305,850 | 12/1942 | Drysdale | 72/322 |
| 2,627,890 | 2/1953 | Lloyd et al. | 72/461 |
| 2,732,879 | 1/1956 | Andresen | 72/322 |
| 2,734,552 | 2/1956 | Yonash | 72/322 |
| 2,971,224 | 2/1961 | Overholser | 72/322 |
| 3,344,635 | 10/1967 | Van Allen | 72/389 |
| 3,553,990 | 1/1971 | Suding | 72/319 |
| 3,740,996 | 6/1973 | Hix | 72/461 |
| 4,081,986 | 4/1978 | Break | 72/320 |

FOREIGN PATENT DOCUMENTS

| | | |
|---|---|---|
| 22122 | 1/1981 | European Pat. Off. . |
| 23894 | 2/1981 | European Pat. Off. . |
| 39322 | 11/1981 | European Pat. Off. . |
| 63041 | 10/1982 | European Pat. Off. . |
| 69661 | 1/1983 | European Pat. Off. . |
| 89904 | 9/1983 | European Pat. Off. . |
| 2004216 | 3/1979 | United Kingdom . |

*Primary Examiner*—Daniel C. Crane

*Attorney, Agent, or Firm*—Henry Sternberg; Bert J. Lewen

[57] ABSTRACT

A bending machine for forming bends in a sheet material. The bending machine has a pair of spaced relatively fixed forming tools for movement with respect to an unclamped portion of the sheet material to effect corresponding bends in the sheet material.

9 Claims, 22 Drawing Figures

BENDING MACHINES

This invention relates to an improved bending machine for forming bends on the edges of sheet metal panels.

The most generally used method of forming bends in sheet material is by means of male and female vee shaped tools in a conventional press brake whereby the sheet material is fed into the tools in a horizontal plane and the sheet at each side of the fold line is raised upwards as the bend progresses.

In the case of a narrow fold on the edge of a large panel it is necessary to manually support the main body of the panel throughout the bending process and also when the tools retract and leave the workpiece unsupported. Handling problems are also caused when successive bends in opposite directions are required, entailing sheet turnover between bending operations. A further disadvantage of the vee tool method is the damage to the sheet surface which commonly occurs where the point of the male vee and the two corners of the female vee contact the material.

A method commonly used in presswork to form one or more edges of a panel simultaneously is to clamp the main body of the sheet and apply a force perpendicular to its surface at or near the point where the bends are to be formed until the sheet material bends. This method normally requires a special tool for each different size of panel and may also result in marking of the material where there has been a peak of pressure applied in forming the bend.

One bending machine which uses this method of bending sheet material is described in UK Patent Publication No. 2004216A. The machine is a fully automatic bending machine requiring no manual intervention and is designed primarily for bending the edges of sheet material to form a shallow rectangular box, tray or panel. The sheet of metal is held in its centre by a vice which is used to slide the sheet material towards a forming tool and is also used for rotating the sheet of material so that a different edge of the sheet material is facing the forming tool.

The machine includes a bending press which includes two vertically facing bending blades which have a reciprocating motion so that the bending blades pass towards and through the plane of the sheet material to form a bend. The face of each bending blade is planar and so as the blade comes into contact with the sheet material it has a tendancy to slide along the material which can cause marking of the material. The application of the load is at one point and thus as the bending blade moves towards and through the plane of the sheet material the force on the sheet material is not constant. In cases where the sheet material has a treated surface such as a plastic coating this will cause creasing and marking which is unsatisfactory.

An improvement to the bending maching is enclosed in European Patent Publication No. 23894. In this machine at least one of the bending blades is adjustably movable towards and away from the clamp which holds the sheet material so that a first portion of the bend is carried out by applying force at a first distance from the bend and then the bending is completed by applying force at a second position closer to the clamp means and the finished bend. However the apparatus required for achieving this movement of the bending blade towards and away from the bend is very complicated and makes the finished machine very costly.

The bending blades of this bending machine are mounted on a C-shaped mounting tool. This means that the distance of the bend to the edge of the material is limited by the depth of the throat of the C-shape mounting tool. This means that the machine can only be used for forming bends very close to the edge of the sheet of material. Additionally the depth of throat restriction prevents the use of a variable position back stop.

According to this invention there is provided a bending machine for forming bends in sheet material including clamp means for clamping part of the sheet material and a forming tool with which force is applied to the unclamped part of the sheet material to effect a bend, characterised in that the forming tool has a curved forming surface extending from the end of the tool along the side of the tool closest to the clamp means such that as the forming tool moves towards and through the plane of the sheet material the point of application of the load moves along the sheet material from the point of first contact with the forming tool towards the clamp, the curve of said surface being such that a substantially constant load is applied by the forming tool on the sheet material.

Thus as the forming tool moves the sheet material is gradually bent such that the load applied remains substantially constant so that the material surface is not damaged.

It has been found that an optimum forming tool is produced if the curve is arranged such that for each constant increment of the forming tool movement, the tangent to the curve at the point of application of the load moves through a constant angle.

However an effective forming tool is produced with a simple curved surface with a single radius. With such a curve, the load applied by the tool remains substantially constant and the point of application of the load moves towards the clamp means as the bend is formed. Thus the effect is that the forming tool rolls into contact with the sheet material which prevents marking of the surface of the material. Also this rolling contact considerably reduces the sliding of the tool along the sheet surface exhibited when the forming tool has a planar face. Thus the tendancy to mark the surface of the sheet material is substantially reduced.

With such a tool an effective bend may be formed with substantially no peaks of load applied, so that bends in material with treated surfaces may easily be formed by using forming tools which only display reciprocating movement, thus obviating the requirement for complicated movement of the forming tool during formation of the bends.

Preferably the bending machine includes two forming tools which are co-linear and facing each other, positioned above and below the clamping means so that bends may be formed in either direction. Preferably the two forming tools are connected together in a mounting frame and move in a reciprocating motion.

Preferably the two forming tools and mounting frame extend along the length of the sheet material and are connected together only at their ends to define a "letter-box" like slot through which sheet material is fed.

Thus the bending machine in accordance with the invention may be used to form bends at any position in the sheet material since the sheet material may be fed through the mounting frame up to a variable position back stop without obstruction.

Preferably the direction of the reciprocating motion of the forming tools may be varied so that the direction of the force applied may be varied. When forming a bend of angle $\psi$ the material has to be bent to an angle of $\psi+\delta$ since the sheet material invariably springs back slightly the distance $\delta$. Thus when a bend of 90° is to be formed a reciprocation motion perpendicular to the sheet material is not sufficient to form the required bend. Thus it is important that the direction of the reciprocating motion of the bending tools may be varied.

In all cases the angle of the bend produced by the bending machine is dependant on the distance moved by the forming tool. Preferably the extent of the reciprocating motion may be limited by adjustable stops so that bends of substantially different angles may be formed.

Preferably the clamp means also has means to limit its movement to clamp the material so that if it is required to form a flattened or partially flattened hem out of the edge of the sheet material the edge of the material is moved so that it is beneath the clamp and the clamp is moved towards the sheet material to a position just above the sheet material so that the edge of the material is flattened into a hem. This is preferably in a form of a stop against which the clamp means bears to prevent further movement towards the sheet material of the clamp and is known as a "scotch".

Preferably the bending machine includes stops behind the clamp means and in front of the clamp means to engage the leading edge and trailing edge of the sheet material so that the position of the bend to be formed may be accurately controlled. The stops which are positioned behind the clamp means may be in the form of contact pads which provide an electrical signal when contacted by the edge of the sheet material. This may be by closing a circuit on the contact pad, or a circuit between the contact, the sheet material and the clamping means of the machine. However when used on a surface coated with a non-conducting material a mechanical contact such as a microswitch is required. Preferably the machine includes at least two back gauge contacts which are slidably mounted on a lateral rail running parallel to the bending tools so that accurate measurement is achieved with any size of sheet material.

Preferably the front stops are in the form of disappearing pawl stops which are pivoted so that the sheet material may be fed forwards across the stops towards the clamp means but cannot be moved backwards from the clamp means since the front stops will have rotated back to the position where the pawl forms a stop. Preferably the front stops are movable so that sheet material of different sizes may be handled. The use of both front and back gauges means that the sheet material may be bent very accurately taking into account any discrepancies in the starting sheet of material.

Preferably the bending machine also includes a movable side guide which along which the sheet material may be fed towards the clamp means.

Preferably the distance of the mounting frame on which the bending tools are mounted from the clamp means may be variable so that different thicknesses of sheet material may be handled.

Preferably the bending machine is programmable so that a series of bends may be formed with either the top or bottom forming tool each operating in different sequences and each capable of moving at a variety of different angles and each capable of variable stroke length limitation.

The position of the back and front stops are variable and programmable so that the position of each bend may be controlled by a microprocessor. Some or all of the functions of the bending machine may be programmed.

The apparatus described may be used to bend a sheet of material at any position on the material by choosing different positions of back and front stops.

However a particularly useful embodiment of the invention has been developed which is useful for forming a shallow rectangular box, tray or panel.

In such apparatus two parallel sides of the tray or box are formed and then one perpendicular edge is bent. In this case the edges of the clamp are shaped to allow the formed edges to slide onto the clamp.

The edge of the clamp running parallel to the forming tool has to equal the width of the sheet material. Preferably the clamp may be contracted laterally to facilitate removal of the half-finished, or finished box or tray from the machine when the bend has been completed.

Preferably this contracting and expanding of the clamp may be programmable. To allow the machine to be used to make different sized boxes or trays, preferably the uncontracted width of the clamp may be variable. This may be in the form of removable spacers.

The bending machine may be hydraulically or mechanically operated, or a combination thereof.

Two examples of bending machines in accordance with the invention will now be described with reference to the accompanying drawings in which.

Figure 1:
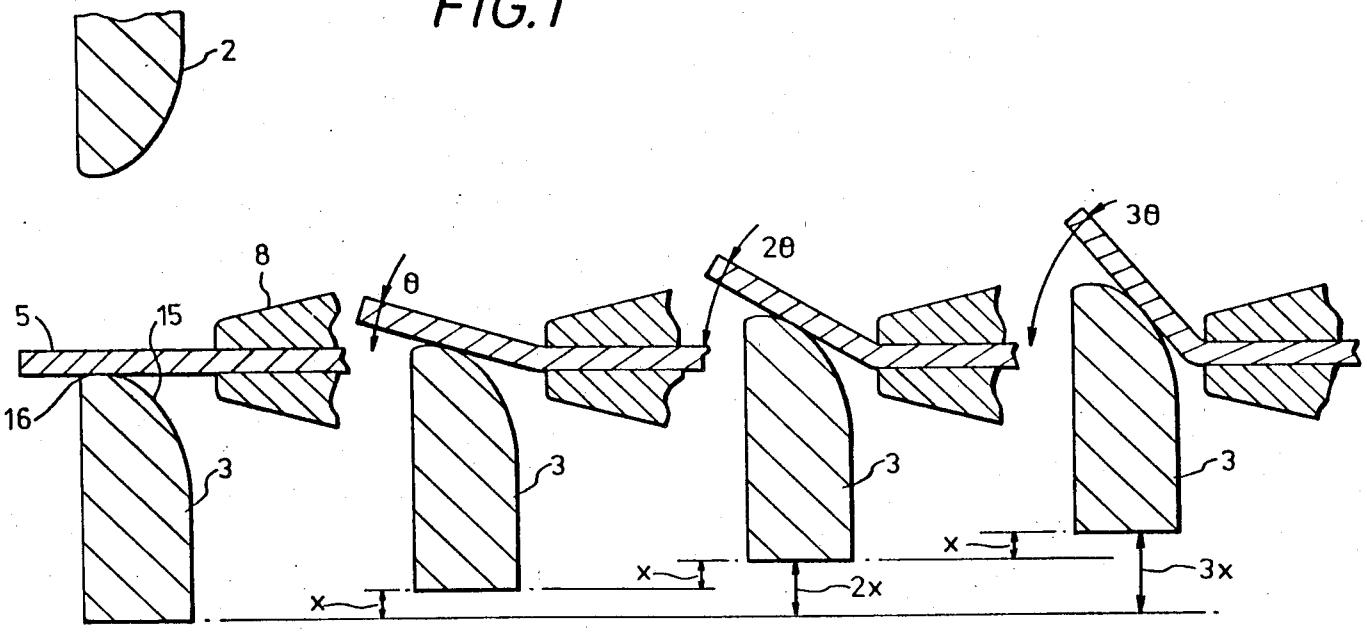
FIG. 1 is a schematic view of one forming tool showing the operation of the bend formed.
Figure 2:
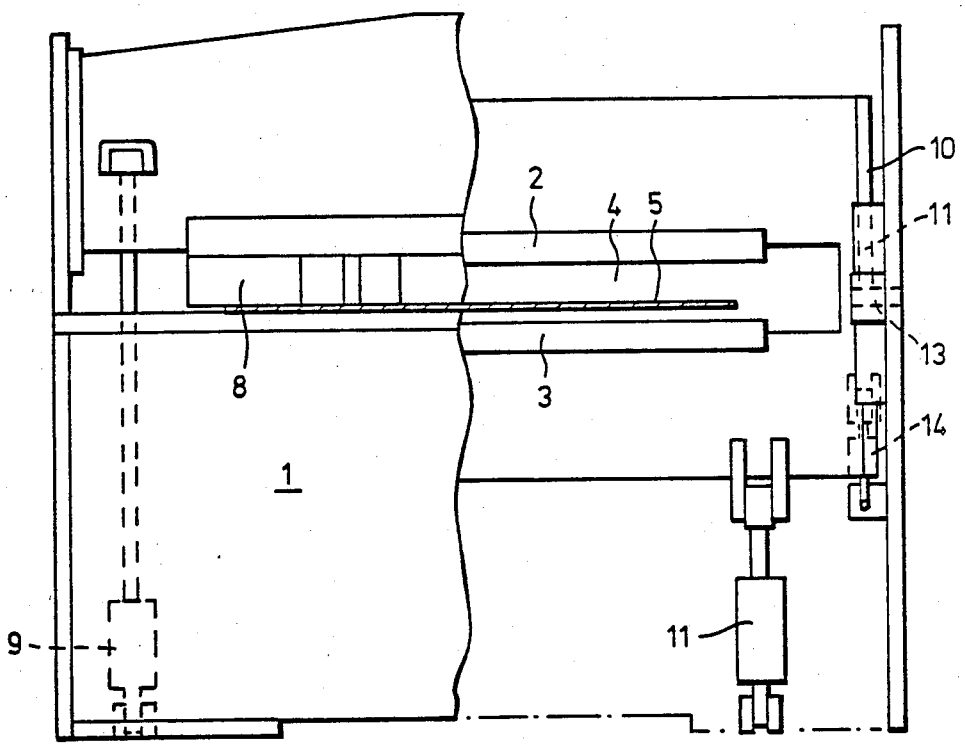
FIG. 2 is a schematic front view of and partial section through a first example of a bending machine.
Figure 3:
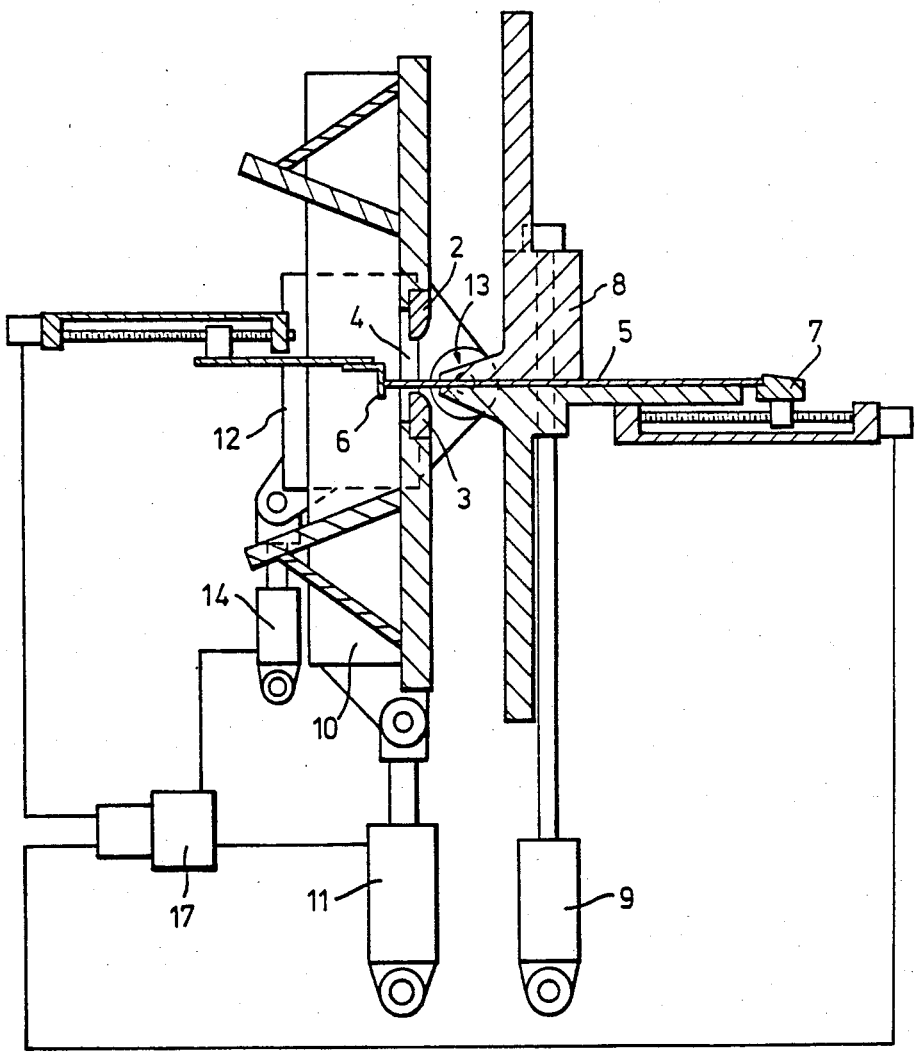
FIG. 3 is a section through FIG. 2.
Figure 4:
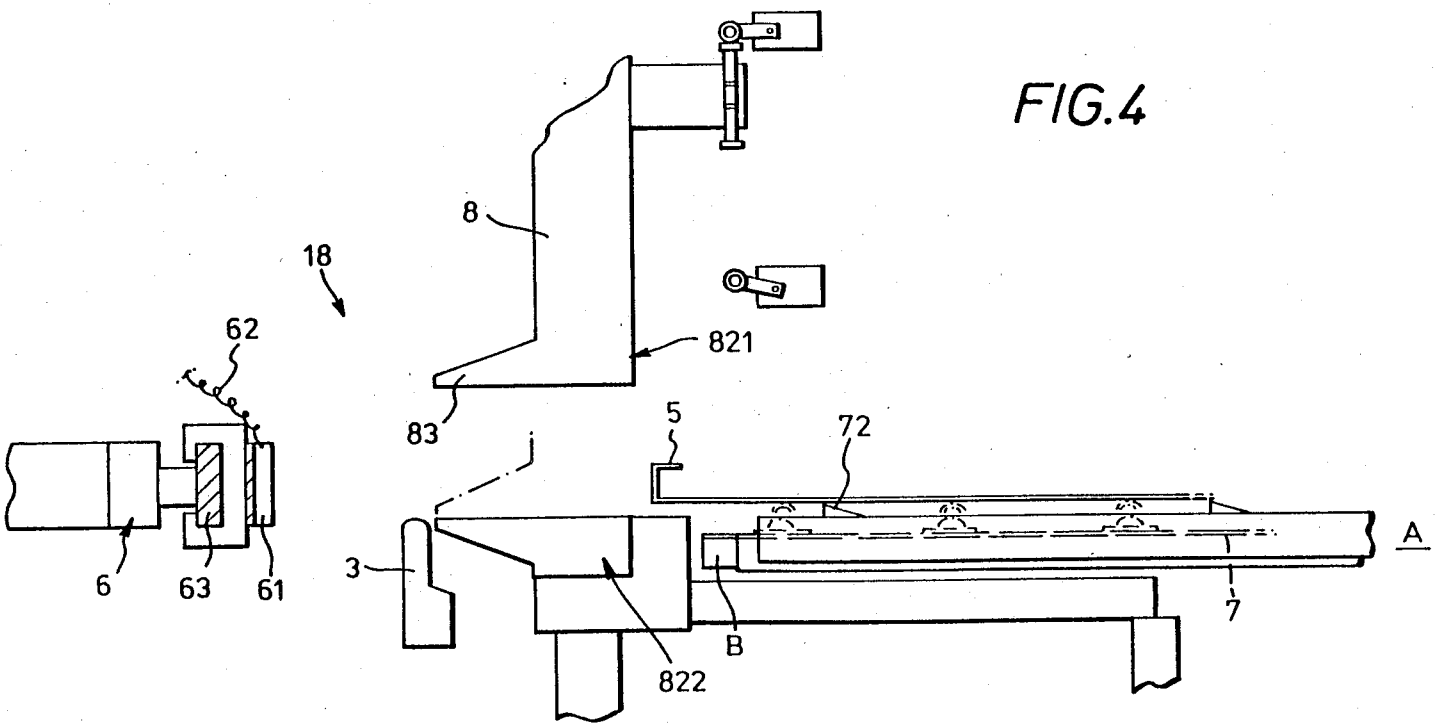
FIG. 4 is a schematic section through a second example of a bending machine.
Figure 5:
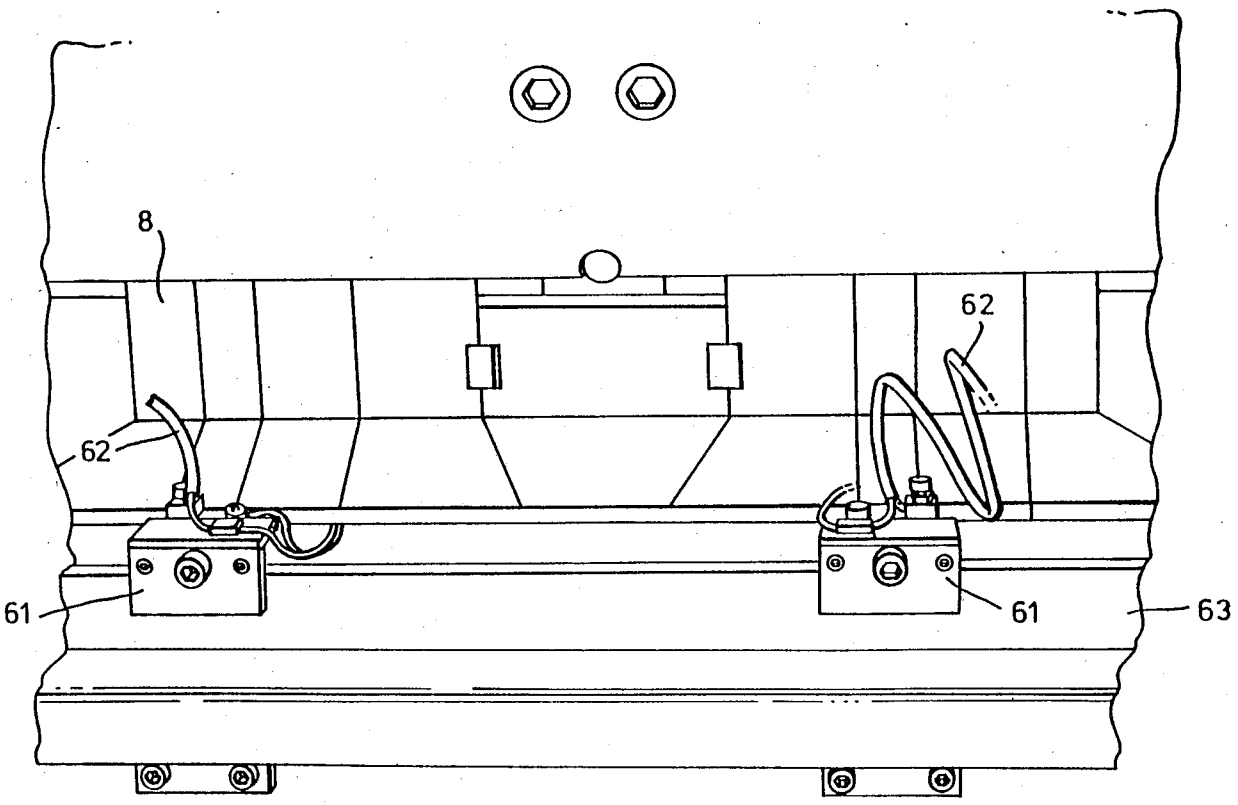
FIG. 5 is a rear view of the machine showing back stops 7.
Figure 6:
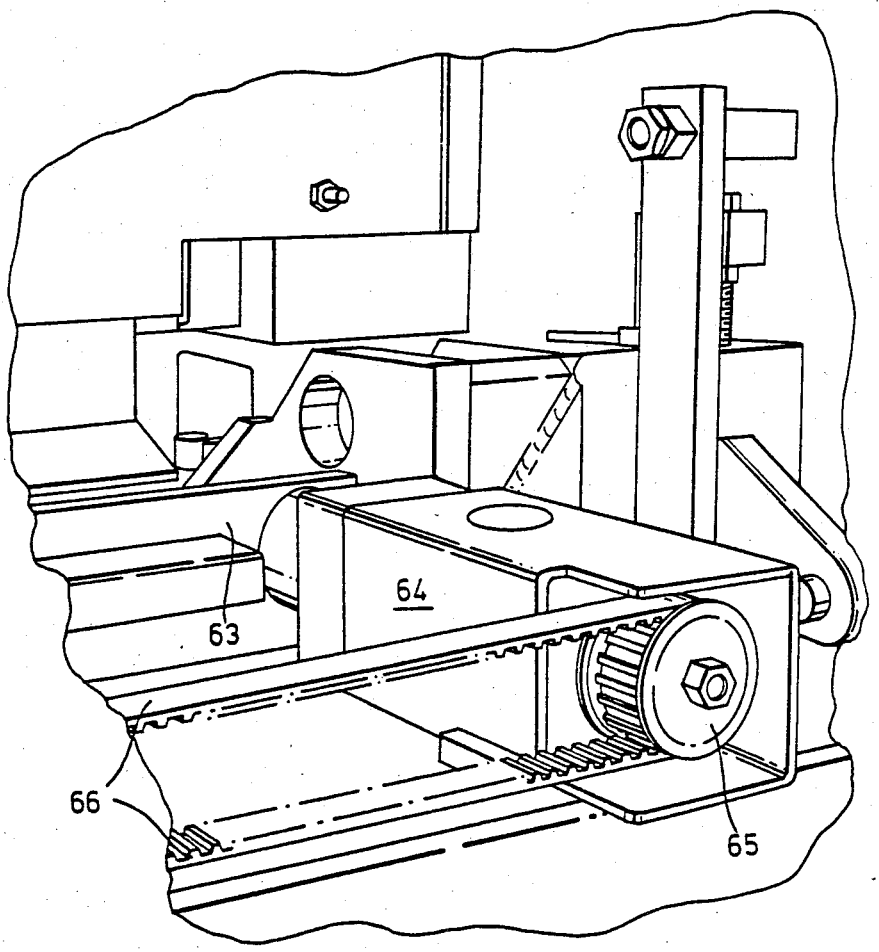
FIG. 6 is a perspective view of the control of back stop 7.
Figure 7:
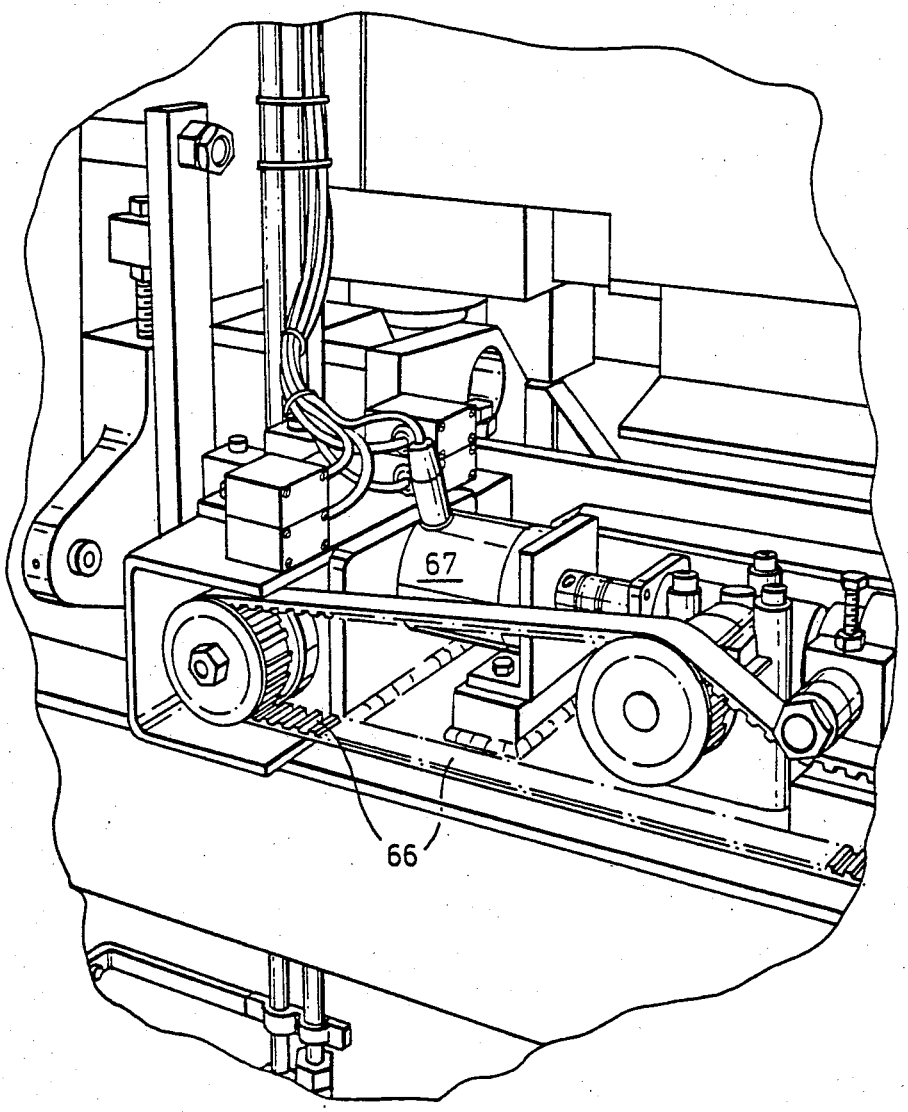
FIG. 7 is a view of the drive for back stops 7.
Figure 8:
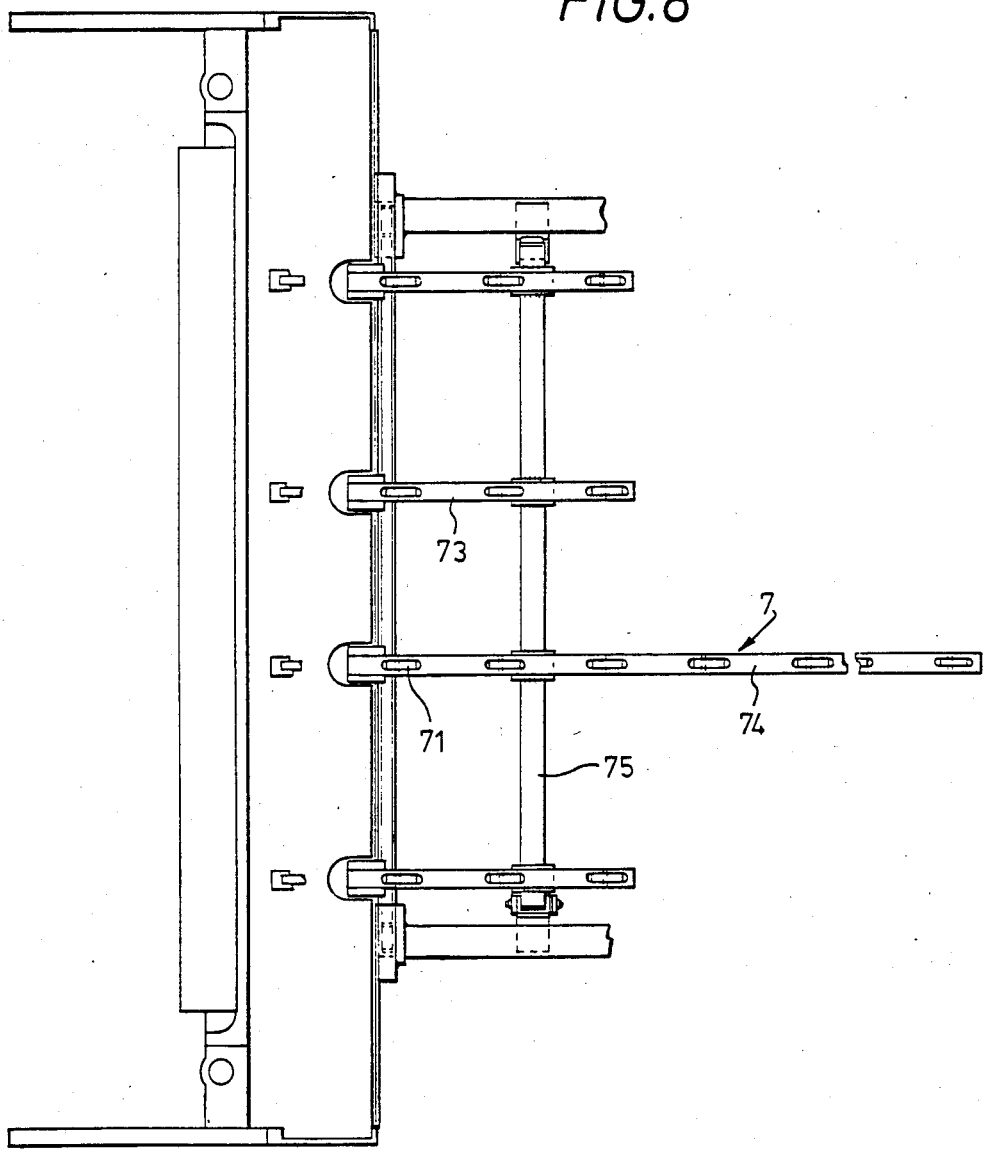
FIG. 8 is a plan view of front stops 6.

In FIGS. 1, 2 and 3 the bending machine is shown including two forming tools 2 and 3. The bending machine shown in the other figures is exactly the same as the first example but includes only one forming tool 3. Components of the second machine will have the same reference numbers as corresponding components of the first machine.

A first bending machine 1 includes two forming tools 2 and 3 between which is defined a longitudinal slot 4 through which the sheet material 5 may be fed up to a back stop 6 and up to a front stop 7. When the sheet material 5 is in position it is clamped using clamp 8 which is controlled by hydraulic cylinders 9.

Forming tools 2 and 3 extend across the length of the sheet material 5 and are connected together at each end to a reciprocating support 10. The movement of support 10 is controlled by hydraulic cylinders 11. A reciprocating support guidance 12 is pivotally mounted via pivot means 13 so that the angle of load application may be varied. The angular movement of the guidance means 12 is controlled by hydraulic cylinders 14.

Each forming tool 2 and 3 has a forming surface 15 which extends from the tip 16 of the tool 2 or 3 along the side of the forming tool 2 or 3 closest to the clamp 8. The curve 15 is such that for a constant increment of the forming tool movement the tangent of the curve at the point of application of the load varies by a constant angle. This means that the load applied at each point of application is substantially constant and a smooth bend is formed. The operation of the formation of the bend is shown in detail in FIG. 1. As forming tool moves distance x the tangent of the curve increases by $\theta$, so that the vertical component of the force applied by the forming tool 3 gradually decreases. As the forming tool moves the point of application of the load moves towards clamp means 8 therefore nearer to the bend. Thus the effective load on the sheet material 5 remains substantially constant. The forming tool rolls into contact with the sheet material 5 so that the surface of sheet material 5 is not damaged and will not have any marks or creases on it.

The bending machine includes a microprocessor 17 which is coupled to the hydraulic cylinders 11, hydraulic cylinders 9 and the front stop 7 and rear stops 6 so that the operation of the bending machine may be controlled.

In the second bending machine 18 there is only one bending tool 3. The back gauge 6 comprises two electrical probes 61 which are coupled to the machine by cables 62. When sheet material 5 contacts stop 61 power is supplied to cable 62 to initiate the bending cycle. The probes 61 are slidable along lateral rod 63 so that the probes 61 may be spaced apart if the sheet material 5 is wider. The rod 63 is coupled via screw box 64 to cog 65 to drive belt 66. Movement of drive belt 66 causes rotation of cog 65 and movement of lateral rod 63 in a direction towards and away from clamp means 8.

A motor (not shown) drives the drive belt 66 via an encoder 67. The encoder 67 is coupled to the microprocessor 17 and is used to control the position to which the lateral rod 63 is moved.

Front stops 7 comprise a plurality of disappearing stops 71 which comprise pivotally mounted pawls 72 which are biased upwards. When sheet material 6 is fed forwards towards the clamp 8 the pawls 72 are pushed downwards to allow the sheet to move forwards. The pawls then release to form a stop against which the material 5 cannot move. Thus the position of the trailing edge of the sheet is fixed. The front stop 7 includes 4 rows 73 of stops 71. Three of the rows 73 include three stops 71 and a middle one 74 includes seven stops 71. The rows 73 are connected to each other by framework 75 which is movable towards and away from the clamp means 8. The distance movable by the framework 75 is greater than the distance between two adjacent stops 71 so that the position of the front stop 71 can be varied up to the full length of the longer member 74.

The movement of the frame 74 is similar to the movement of lateral slide rods 63 described above.

Figure 9:
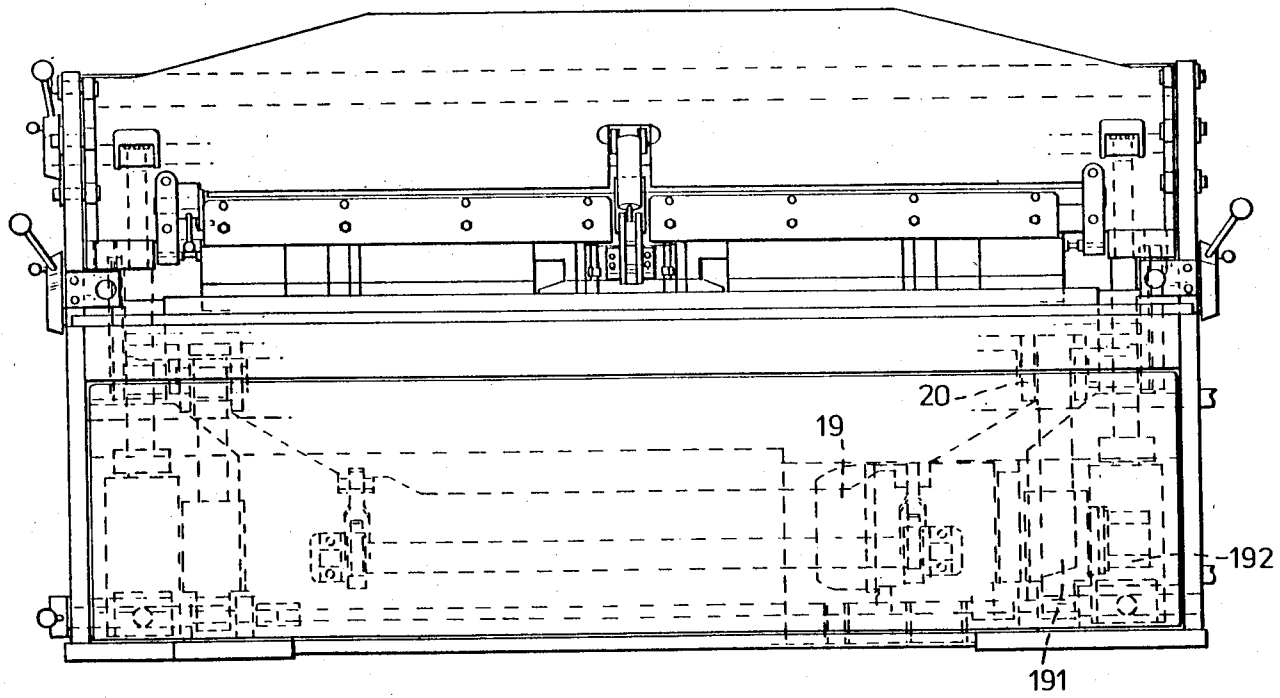
FIG. 9 is a front view of the machine.
Figure 10:
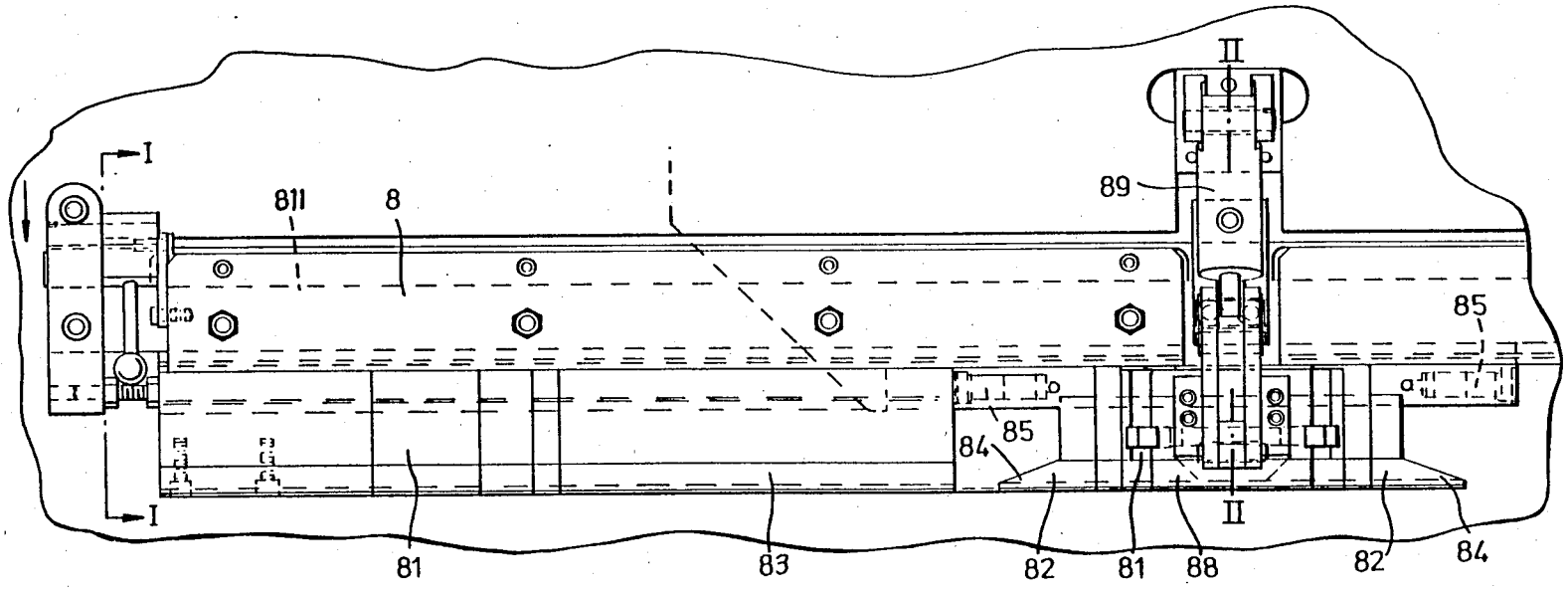
FIG. 10 is a front view of clamp 8.
Figure 11:
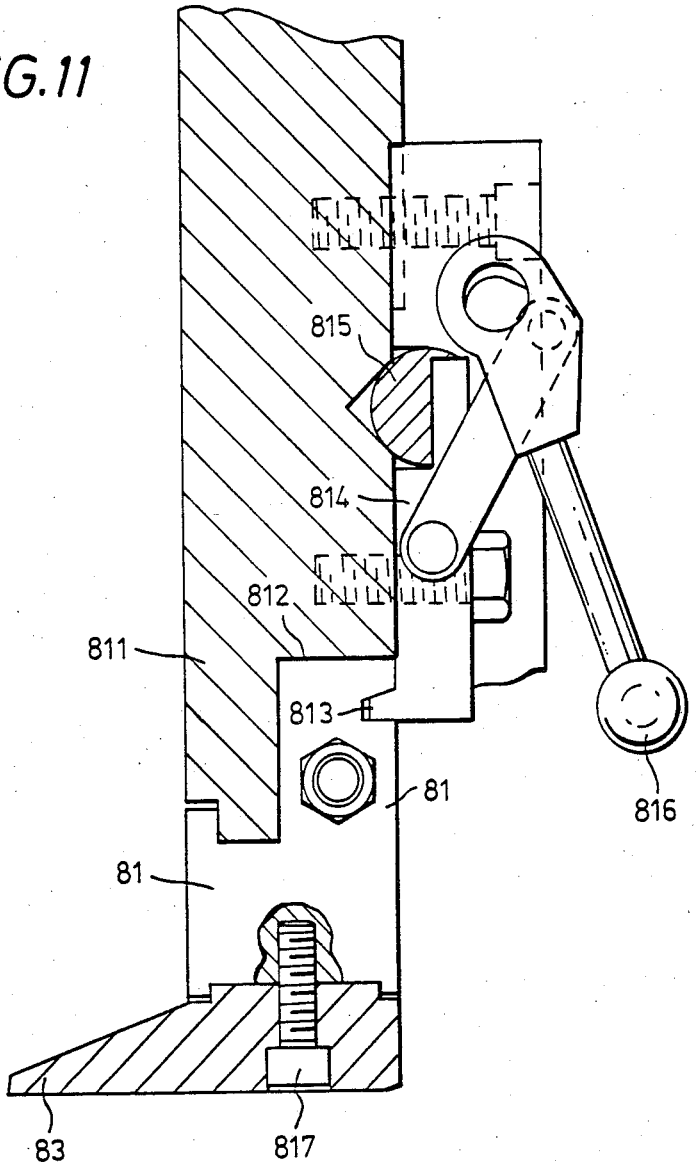
FIG. 11 is a section through I—I of FIG. 10.
Figure 12:
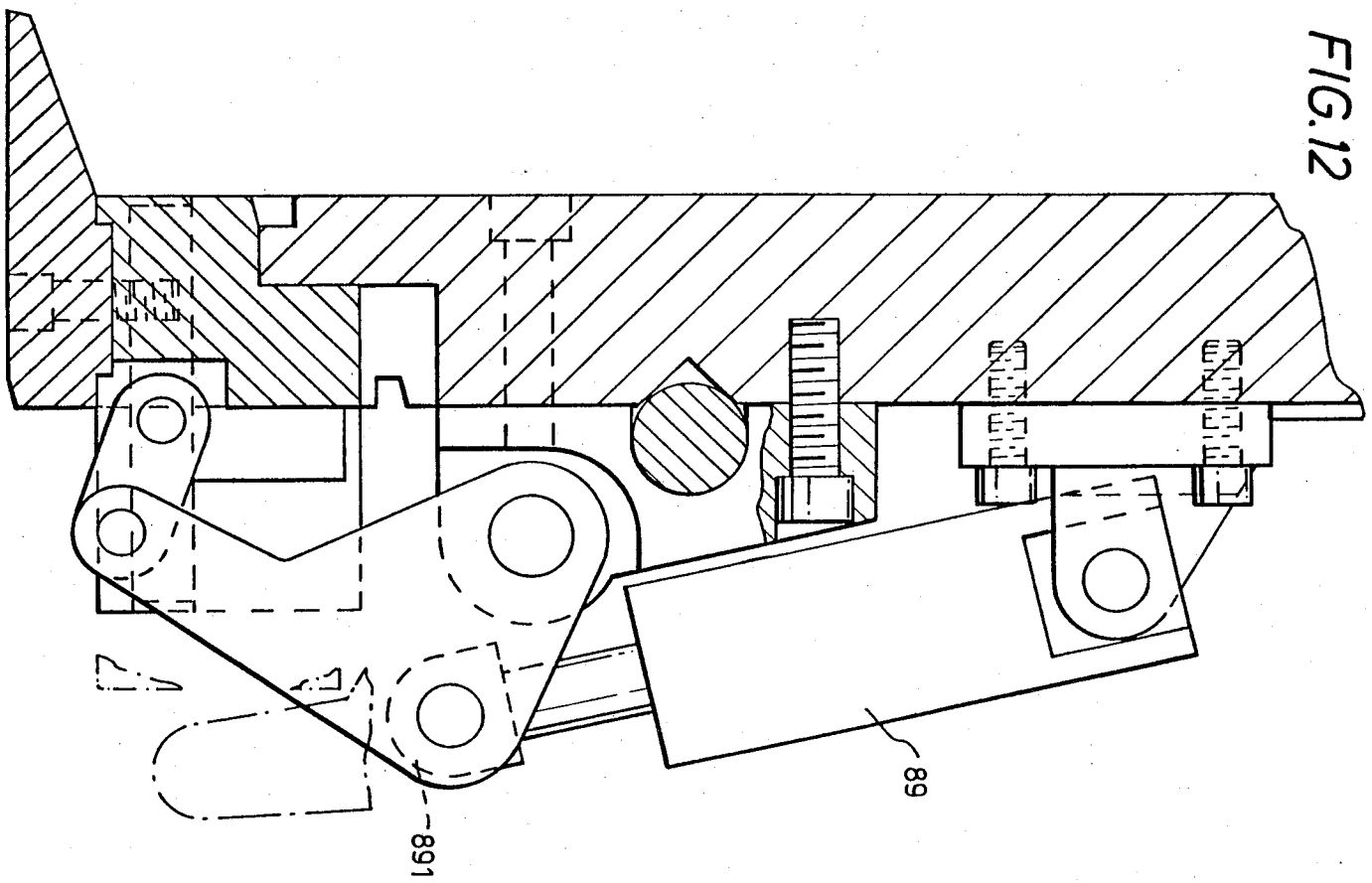
FIG. 12 is a section through II—II of FIG. 10.
Figure 13:
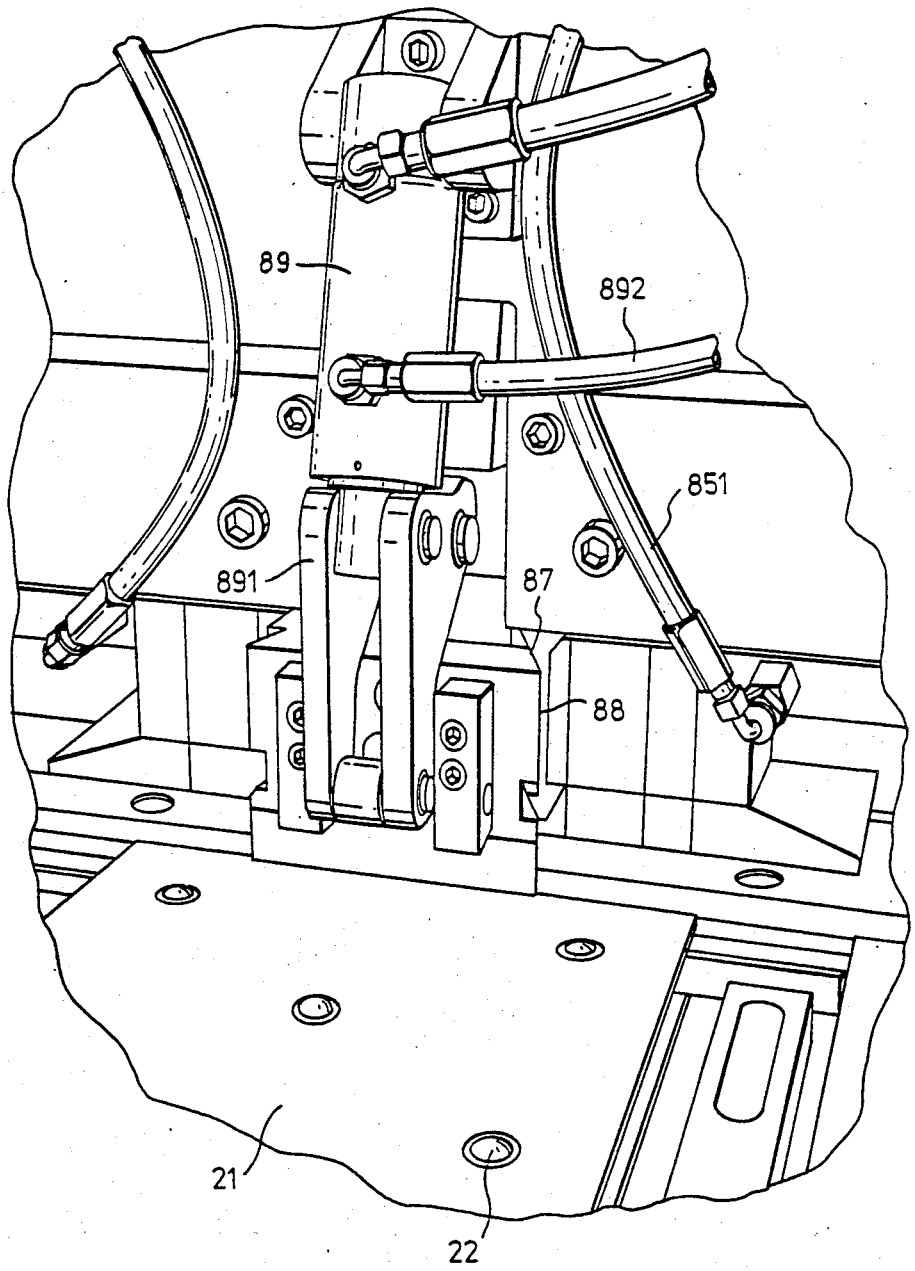
FIG. 13 is a perspective view of the clamp 8.
Figure 14:
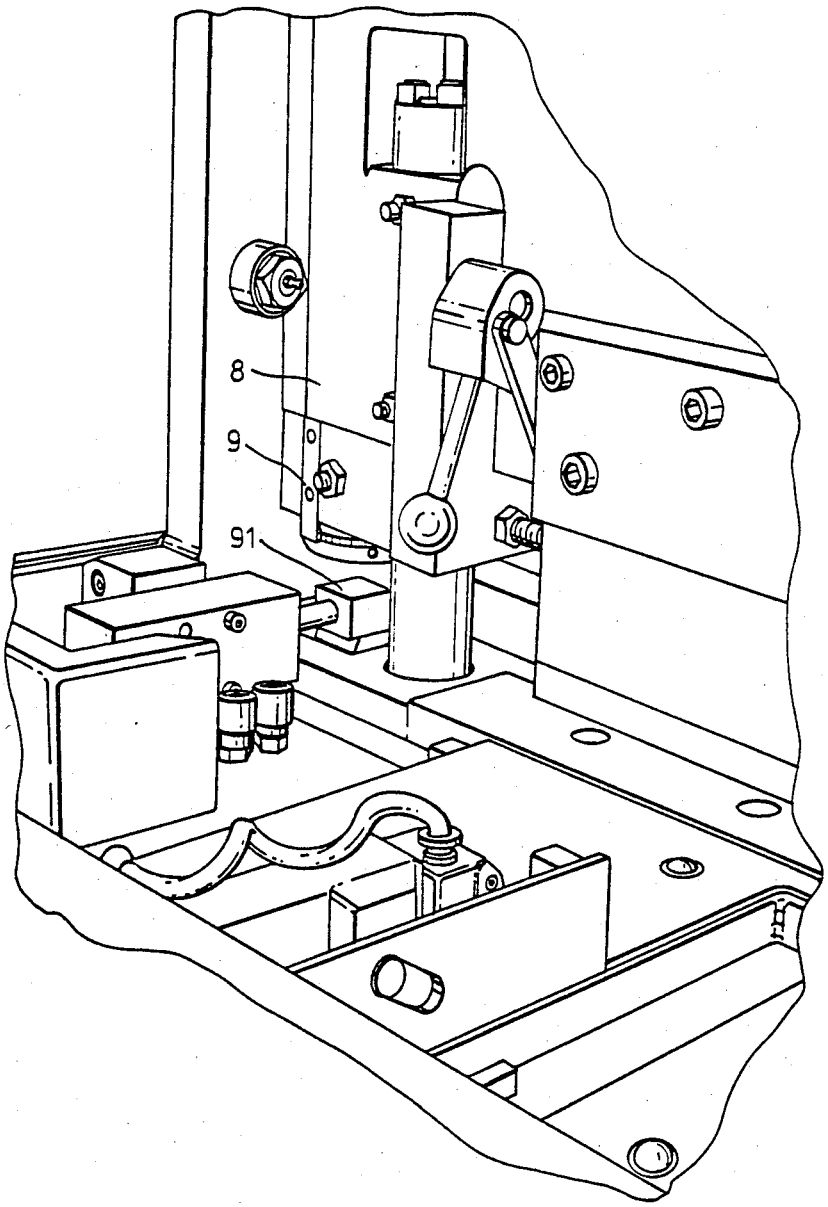
FIG. 14 is a perspective view of the end of clamp 8.
Figure 15:
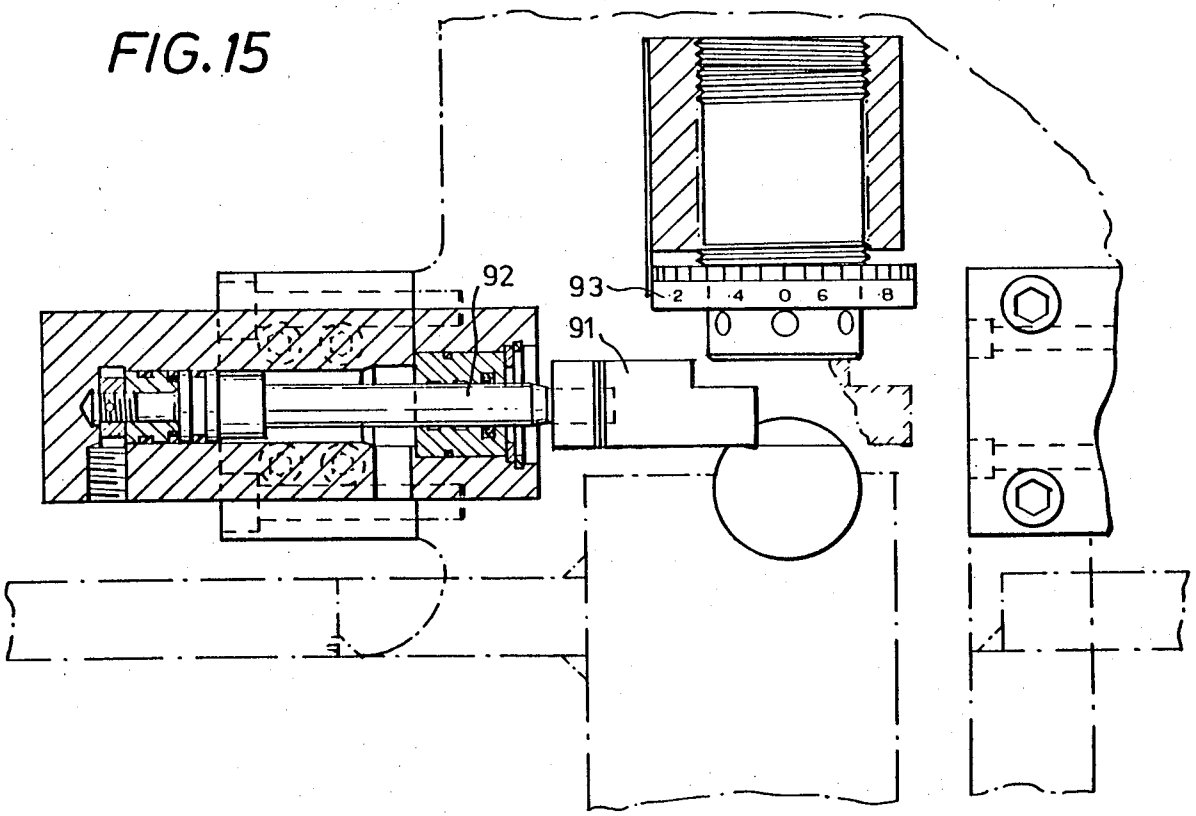
FIG. 15 is a section through FIG. 14.
Figure 16:
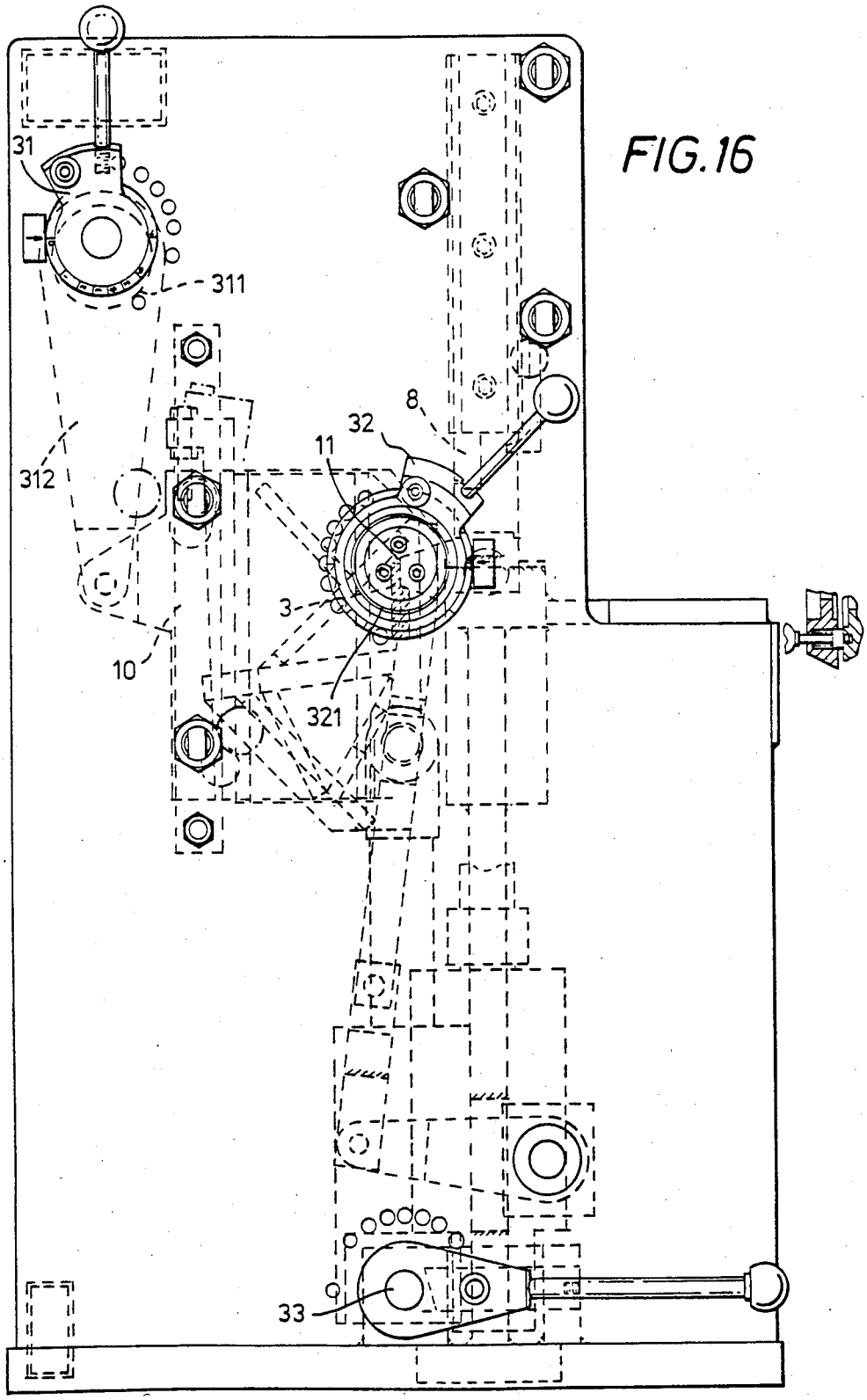
FIG. 16 is a side section of the machine.
Figure 17:
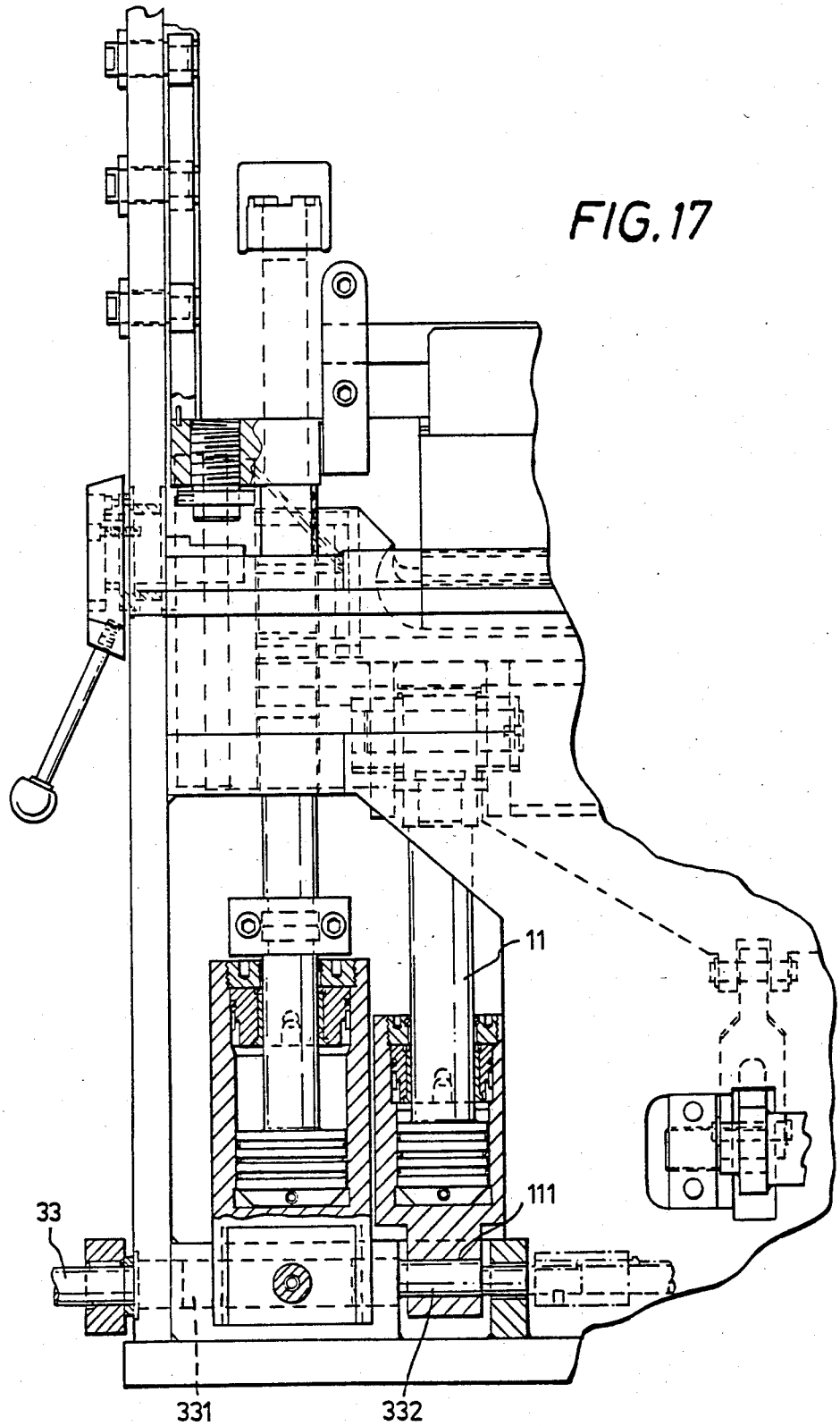
FIG. 17 is a front section through one end of the machine.
Figure 18:
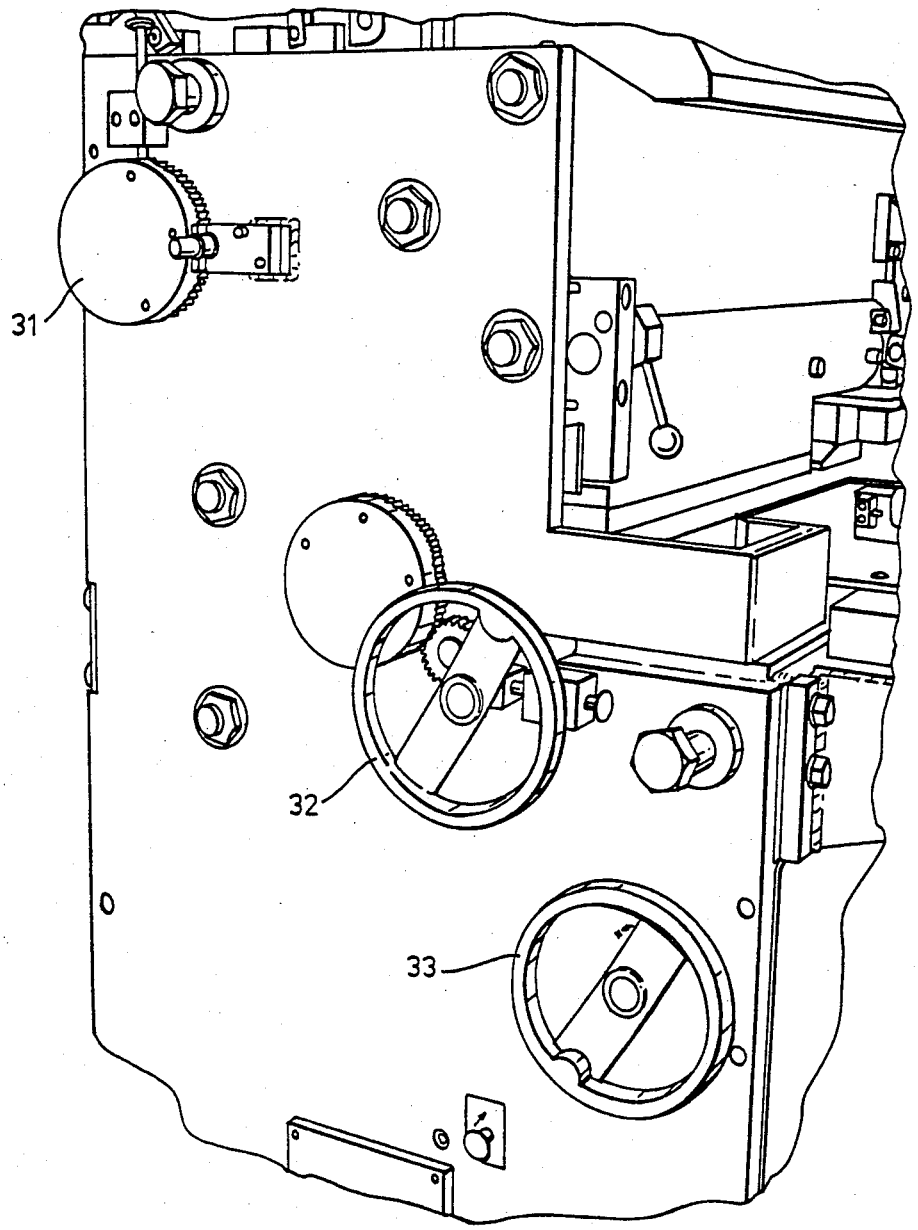
FIG. 18 is a side view of the machine.
Figure 19:
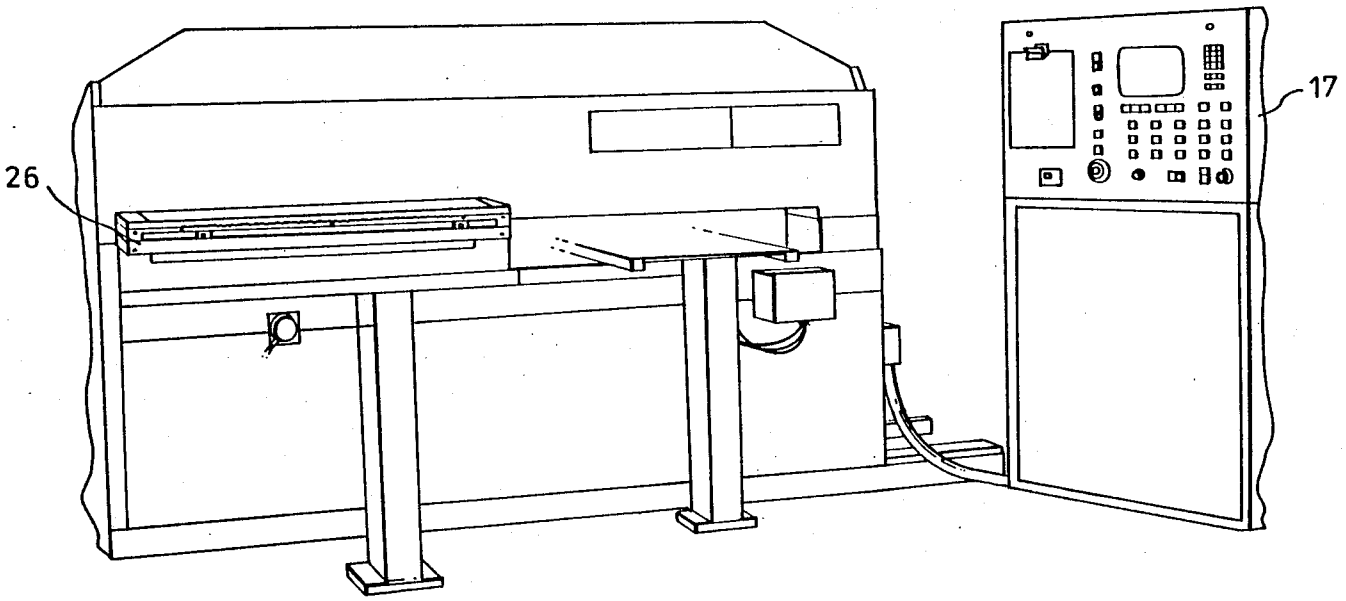
FIG. 19 is a front view of the machine.
Figure 20:
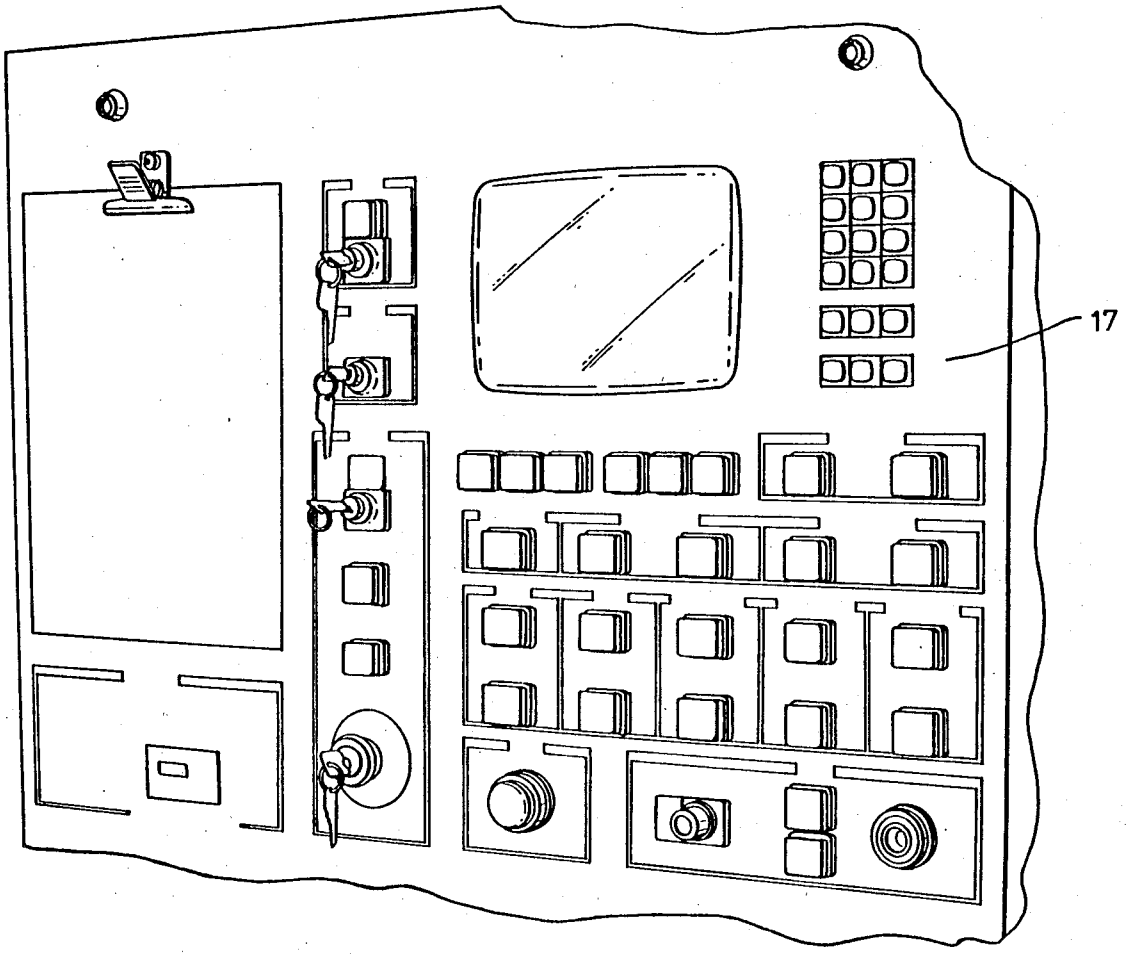
FIG. 20 is a perspective view of the microprocessor control.

The position of the main motor 19 is shown clearly in FIG. 9. The motor is any standard A C Squirrel cage motor. The motor 19 is coupled via a bell housing 191 to an hydraulic pump 192. The hydraulic pump 192 supplies hydraulic power for actuation of all the control and operating cylinders.

Clamp 8 comprises an upper clamp member 821 and a lower member 822. The upper clamp member 821 comprises a plurality of spacer members 81 and two outer members 82. In order to accommodate the shape of the box produced by the sheet material the clamp 8 includes a foot 83 facing towards the forming tool 3. Also the two end members 82 include laterally extending feet 84 which accommodate two completed parallel sides of a box when a perpendicular to the parallels is being formed. Within each of end members 82 is a hydraulic cylinder 85 which when actuated bears against auxiliary spacer members 81 urging the two end members 82 towards each other. A wedge shaped member 86 is movable into a wedge shaped hole 87 formed in two inner members 88. Hydraulic cylinder 89 is pivotally connected to mounting means 891 which is pivotally connected to wedge shape member 86. When hydraulic cylinder 89 is actuated the mounting means 891 rotates and forces the wedge shape member 87 between inner members 88. If pressure is released from hydraulic cylinder 89 the wedge shaped member 87 moves away from inner members 88. Pressure is applied to hydraulic cylinders 85 which allow the end members 82 to move inwards to allow the clamp to contract. Hydraulic leads 851 to the cylinders 85 and hydraulic leads 892 to hydraulic cylinder 89 are coupled so that the operation of the cylinder is synchronized. The width of the clamp 8 produced by inner members 88 spacer members 81 and end members 82 can be varied by adding further spacer members 81 between the inner member 88 and the end member 82. The clamp 8 is mounted on a lateral mounting means 811 which extends across the width of the machine and includes groove 812 into which the spacer members 81 fit. Each spacer member 81 includes a lateral groove 813 which is engagable by a pivoting clamp 814 pivotally mounted on pin 815 which runs laterally over the machine. Handle 816 is used to pull clamp means 814 out of contact with the spacer means 81 to allow changing of the spacer members 81 along the width of the machine. The feet 83 of the spacer means 81 are replacable since they are fixed to the spacer means 81 by means of screws 817 which are easily removable.

Sheet material is fed into the bending machine on a mounting table 21 including a plurality of bearing 22 to allow the sheet material 5 to roll easily into position.

The table 21 is movable from a first raised position (A) level with lower clamp 822 to a second lowered position (B) beneath the level of the clamp 822.

The sheet material 5 is fed forwards into position with the table 21 raised to clear the front stops 7. The table 21 is then lowered and the sheet material bears on the frame 75 of the front stops.

The clamp 8 includes mean 91 for limiting the downward stroke of hydraulic cylinder 9. Stop 91 is connected to hydraulic cylinder 92 so that it is movable from a position where it interferes with the downward stroke of cylinder 9 to a position where it is retracted and does not interfere with this movement. In normal operation of the machine scotch 91 is fully retracted and hydraulic cylinders 9 cause the clamps to clamp firmly on the sheet material 5. However when it is required to form a hemmed edge the edge of the material 5 is placed under the clamp 8 and hydraulic cylinder 92 pushes scotch 91 into position. The hydraulic cylinder 9 then moves downwards until it contacts scotch 91 whereupon movement downwards of clamp 8 stops. A rotatable gauge 93 is used for finely adjusting the effect of scotch 91 on the movement of the clamp.

The angle of approach of bending tool 3 may be varied by a movement of lever 31 which is coupled to reciprocating support 10 which controls the angle of the reciprocating movement of bending tool 3.

Rotation of lever 31 rotates an eccentric shaft 311 running laterally of the machine. Shaft 311 is connected via link 322 to reciprocating support 10. The rotation of shaft 311 causes link 312 to reciprocate and causes support 10 to pivot about pivot point 11. This changes the angle of approach of bending tool 3.

Handle 32 is used to vary the distance of bending tool 3 from clamp means 8 by movement of pivot point 11. A shaft 321 is slightly eccentric with respect of pivot point 11. Rotation of handle 32 relates shaft 321 which causes slight movement of bending tool 3 with respect to the clamp 8. Thus different thicknesses of material 5 may be accommodated.

A further handle 33 is used for varying the movement of the bending tool 3 by varying the stroke of hydraulic cylinder 11 which controls movement of forming tool 3. Within the cylinder 11 is a bore 111 through which runs a lateral shaft 33 connected via a chain drive (not shown) to handle 33. The lateral shaft 33 includes an eccentric portion 332 within bore 111 so that rotation of handle 33 moves the cylinder 11 vertically which changes the position of the stroke of the cylinder 11. This means that the position of the movement of the bending too 3 changes so that the end position of the movement changes to allow a different angled bend to be formed.

Preferably the positions of the stops and the angle and position of the reciprocating motion of the bending tool 3 are preprogrammed to the microprocessor 17 for each particular shape required to be made by the bending machine. The operator of the machine signals to the microprocessor that the first bend is to be made which sets the first rear stop to its required position and the position and extent of movement of the forming tool is preprogrammed. The operator then feeds the sheet material into the back stop and the bend is effected at the required position.

A side guide 26 is positioned at the front of the machine. It is used to guide one side edge of the sheet material 5 towards the bending tool 3. The side guide 26 is slidable across the front of the machine so that different widths of material may be handled. The movement of side guide 26 is controlled in a similar manner to the movement of back stops 6 and front stops 7.

Across the front of the machine is a photoelectric guard (not shown) which automatically shuts off operation of the machine if any foreign body (for example, a hand) passes through the guard.

Figure 21:
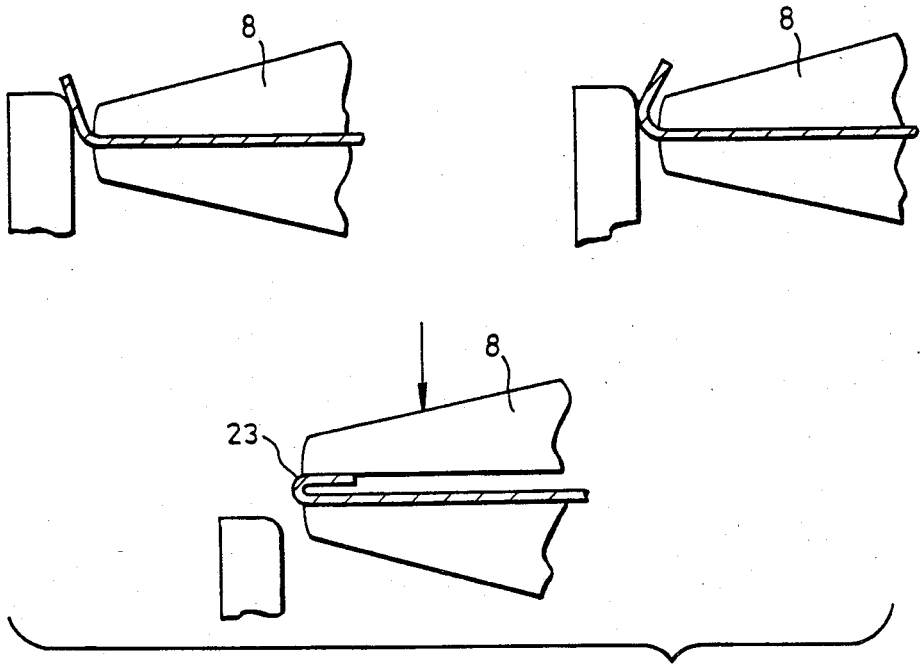
FIG. 21 is a schematic view of how a hemmed edge is formed.
Figure 22:
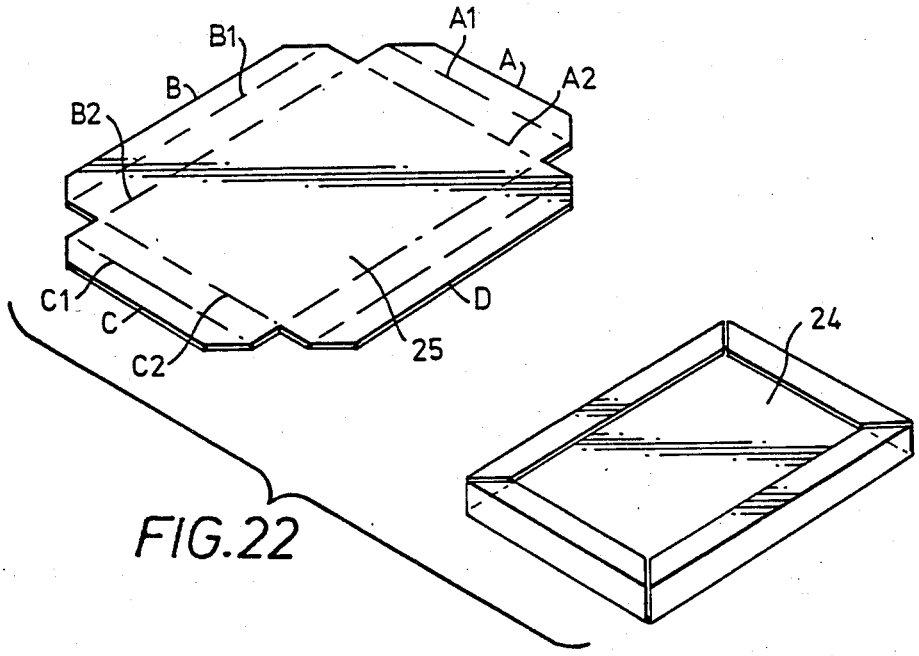
FIG. 22 is a schematic view of a box formed by the machine.

FIG. 21 shows schematically how a hemmed safe edge may be formed using the scotch limiting the clamps movement. The edge of the sheet material is bent to an angle of over 90° in two steps. The sheet material is then pulled so that the end of the material is under the clamp 8 and the clamp 8 is brought downwards to form a hemmed edge 23.

A method of making box 24 from blank 25 will now be described to clarify the operation of the machine. The machine may be used to make any number and shape of bends according to the programme in the microprocessor 17.

1. Sheet 25 is loaded such that edge A contacts back guage 61 and side B is in contact with the side guide 26.
2. Clamp 8 descends to its clamped position.
3. Back gauge 61 is retracted.
4. Bending beam 3 is raised to produce its first bend.
5. Bending beam 3 is then lowered.
6. The sliding rod 63 carrying the back gauges is then moved to its second position.
7. Clamp 8 is raised to clear the component.
8. The back of the component is fed towards the back gauge 61 to A1.
9. Clamp 8 is lowered.
10. Back gauge 61 is retracted.
11. Bending beam 3 is raised.
12. Bending beam 3 is lowered.
13. Clamp 8 is raised to clear the component.
14. The component 5 has to then be pushed inwards to clear the foot 83 of the clamp.
15. Clamp 8 is fully raised.
16. Slide guide 26 is moved to its extreme left.
17. Table 21 is raised so that the component may slide easily out of the clamp over bearings 22 and is then rotated through 180°.
18. The side guide 26 is returned to its first position.
19. The front gauge 71 is moved to its first position.
20. Table 21 is lowered.
21. Component is located with A2 against front gauge 61 so that the distance between the bend A2 and the bend C1 to be formed is exactly as required. Side D is now fed along the side guide 26.
22. Clamp 8 is lowered.
23. Bending tool 3 is raised.
24. Bending tool 3 is lowered.
25. Clamp 8 is raised to clear the component.
26. The front gauge is moved to its second position.
27. Edge D is maintained in contact with the side gauge and A2 with the front gauge 71.
28. Clamp 8 is lowered.
29. Bending beam 3 is raised.
30. Bending beam 3 is lowered.
31. Clamp 8 is raised to clear the component.
32. The component is pushed inwards to the foot 83 of the clamp 8.
33. Top clamp is raised fully.
34. Side gauge is moved to its next position.
35. Table 21 raised.
36. Component withdrawn and rotated through 90°.
37. Back gauge 71 is moved to its next position.
38. Table 21 lowered.
39. C2 is placed against the side guide 26 and B is located on back guage 71.
40. Clamp 8 descends.
41. Back guage 71 retracts.
42. Forming tool 3 is raised.
43. Forming tool 3 is lowered.
44. Back gauge 71 to its next position.
45. Clamp 8 is raised to clear component.
46. B1 is located against back gauge 71.
47. Clamp 8 is lowered.
48. Back gauge 71 retracted.
49. Bending tool 3 raised.

50. Bending tool 3 lowered.
51. Clamp 8 is raised to clear component.
52. Component pushed forwards to clear foot 83.
53. Clamping tool 81 contracted by hydraulic cylinders 85 and 89 to allow feet 84 to clear sides C and A of the box.
54. Clamp 8 fully raised.
55. Table 21 raised.
56. Component withdrawn and rotated through 180°.
57. Front gauge 71 to next position.
58. Table 21 lowered.
59. Component fed in with A2 to side guide 26 and B2 against front gauge 71.
60. Clamp 8 lowered.
61. Forming tool 3 raised.
62. Forming tool 3 lowered.
63. Clamp 8 raised.
64. Front gauge 72 to next position.
65. A2 is maintained against side guide 26 and B2 at front gauge 71.
66. Clamp 8 lowered.
67. Forming tool 3 raised.
68. Forming tool 3 lowered.
69. Clamp 8 raised to clear component.
70. Clamping tool retracted so that component clear feet 84 of clamp.
71. Component pushed inwards to clear foot 82.
72. Top clamp 8 fully raised.
73. Table 21 raised.
74. Finished component withdrawal.
75. Table 21 lowered.
76. Back gauge and side guide returned to first position.
77. Top clamp expanded to its original size.

We claim:

1. A bending machine for forming sharp bends in sheet material, comprising:

clamping means for clamping part of said sheet material;

forming means mounted adjacent said clamping means;

said forming means comprising a pair of forming tools which are coplanar and facing each other and fixed relative to one another, each of said forming tools being an elongate member having a forming edge for contacting the opposite faces, respectively, of the unclamped portion of said sheet material to effect a bend in a corresponding one of two directions and both said forming tools being located on a unitary mounting frame, the space between said forming tools defining a slot through which the sheet material may be fed;

means for moving said forming means such that the angle between the plane of the clamped section of said sheet material and the direction of motion of said forming means remains substantially constant throughout any one bending action; and means for adjusting the forming means relative to the clamping means to select said angle according to the nature of the sheet and the desired bend and to allow for spring back of the material after bending.

2. A bending machine according to claim 1, which includes stop means in front of and behind the clamp means to locate the sheet material and thereby determine the position of the bend.

3. A bending machine according to claim 1 in which the forming tool has a curved forming surface extending from the end of the tool along the side of the tool closest to the clamp means such that as the forming tool moves toward and through the plane of the sheet material, the point of application of the load moves along the sheet material from the point of first contact with the forming tool towards the clamp, the curve of said surface being such that a substantially constant load is applied by the forming tool on the sheet material.

4. A bending machine according to claim 1 in which a side guide guides the sheet material towards the clamp means.

5. A bending machine according to claim 1 in which the clamp means may be contracted to facilitate removal of the bent material.

6. A bending machine according to claim 1 in which the clamp means may be used to hem the material, the machine including a retractable stop to limit movement of the clamp.

7. A bending machine according to claim 1 in which the distance moved by the forming tool past the plane of the sheet material to effect a bend is variable.

8. A bending machine according to claim 1 in which the distance between the forming tool and the clamp means is variable.

9. A bending machine according to claim 1 which is microprocessor controlled.

* * * * *